US008104628B2

(12) United States Patent
Kim

(10) Patent No.: US 8,104,628 B2
(45) Date of Patent: Jan. 31, 2012

(54) DISHWASHER RACK HAVING SLIDABLY COUPLED TINE HOLDER AND TINE RACK

(75) Inventor: Ji Ho Kim, Busan (KR)

(73) Assignee: LG Electronics Inc., Seoul (KR)

( * ) Notice: Subject to any disclaimer, the term of this patent is extended or adjusted under 35 U.S.C. 154(b) by 1395 days.

(21) Appl. No.: 11/286,335

(22) Filed: Nov. 25, 2005

(65) Prior Publication Data

US 2006/0108298 A1 May 25, 2006

(30) Foreign Application Priority Data

Nov. 25, 2004 (KR) ..... 10-2004-0097270

(51) Int. Cl.
*B65D 6/08* (2006.01)

(52) U.S. Cl. ..... 211/41.8; 211/171; 211/181.1; 220/488

(58) Field of Classification Search ..... 211/41.1–41.9, 211/170, 171, 151, 181.1, 94.01, 94.02; 134/135; 312/228.1, 311, 410; 220/572, 487, 488
See application file for complete search history.

(56) References Cited

U.S. PATENT DOCUMENTS

| | | | | |
|---|---|---|---|---|
| 3,752,322 | A * | 8/1973 | Fiocca et al. | 211/41.8 |
| 5,462,348 | A * | 10/1995 | Ellingson et al. | 312/301 |
| 5,601,195 | A * | 2/1997 | Finola et al. | 211/41.8 |
| 2003/0089672 | A1 * | 5/2003 | VanLandingham | 211/41.8 |
| 2005/0109378 | A1 * | 5/2005 | Landsiedel et al. | 134/135 |

FOREIGN PATENT DOCUMENTS

| | | |
|---|---|---|
| DE | 29714515 U1 | 2/1999 |
| KR | 10-1999-0075791 | 10/1999 |

* cited by examiner

*Primary Examiner* — Michael Safavi
(74) *Attorney, Agent, or Firm* — McKenna Long & Aldridge LLP

(57) ABSTRACT

A dishwasher rack is provided. The dishwasher rack includes a tine holder, a tine holder moving portion, and/or a movable rack moving portion. The tine holder includes a plurality of portions formed to receive a holding tine for adjusting a gap between the holding tine and a structure opposite to the holding tine, according to a received position of the holding tine. The tine holder moving portion changes a position of the tine holder with respect to the rack frame. The movable rack moving portion changes a position of the movable rack with respect to the rack frame.

12 Claims, 11 Drawing Sheets

DISHWASHER RACK HAVING SLIDABLY COUPLED TINE HOLDER AND TINE RACK

This application claims the benefit of Korean Application No. 2004-0097270, filed on Nov. 25, 2004, which is hereby incorporated by reference as if fully set forth herein.

BACKGROUND OF THE INVENTION

1. Field of the Invention

The present invention relates to a dishwasher, and more particularly, to a dishwasher rack.

2. Description of the Related Art

A dishwasher sprays wash liquid towards an upper rack and a lower rack to wash dishes stored in each rack.

From conventional dishwashers, there is a structure that includes movable tines on a dish rack that are coupled to receiving portions. A tine receiving portion is a structure fixed to a rack frame of the dish rack, and has a plurality of recesses formed for receiving the movable tines. One end of a movable tine is coupled to the rack frame of the dish rack, and the other end is received by the tine receiving portion. When a movable tine is received in a recess of the tine receiving portion, the movable tine is angled according to the location of the groove in which the received tine is at. Thus, dishes are placed in the spaces formed between movable tines.

However, a tine receiving portion and the movable tine according to the related art are respectively fixed to the rack frame, and therefore, their range of movement is restricted. Thus, assorted sizes and shapes of dishes cannot be stored. Furthermore, when the size of dishes is larger than the parameter of tine movement, the dishes cannot be securely placed between the tines.

Additionally, because tine receiving portion and movable tine according to the related art are respectively sized and spaced in design dimensions suitable for the rack frame, if there is a change to the shape of the dish rack, the tine receiving portion and the movable tine will not be compatible. Therefore, manufacturing cost increases, as does manufacturing time.

SUMMARY OF THE INVENTION

Accordingly, the present invention is directed to a dishwasher rack that substantially obviates one or more problems due to limitations and disadvantages of the related art.

An object of the present invention is to provide a dishwasher rack with a movable rack installation structure capable of easily and securely storing a variety of sizes and shapes of dishes.

Another object of the present invention is to provide a dishwasher rack with a movable rack that is compatible with a rack of an altered shape.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher rack including: a rack frame; a movable rack provided in the rack frame and including a holding tine; a tine holder including a plurality of portions formed to receive the holding tine for adjusting a gap between the holding tine and a structure opposite to the holding tine, according to a received position of the holding tine; a tine holder moving portion for changing a position of the tine holder with respect to the rack frame; and a movable rack moving portion for changing a position of the movable rack with respect to the rack frame.

In another aspect of the present invention, there is provided a dishwasher rack including: a rack frame; a holding tine provided on the rack frame; a tine holder including a plurality of portions formed to receive the holding tine for adjusting a gap between the holding tine and a structure opposite to the holding tine, according to a received position of the holding tine; and a tine holder moving portion for changing a position of the tine holder with respect to the rack frame.

In a further another aspect of the present invention, there is provided a dishwasher rack including: a rack frame; a movable rack provided in the rack frame; and a movable rack moving portion for changing a position of the movable rack with respect to the rack frame.

The dishwasher rack according to the present invention allows the free adjustment of the angle and range of movement of upright tines for storing dishes in the rack, so that dishes of various sizes (from small through large) and shapes can be stored.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
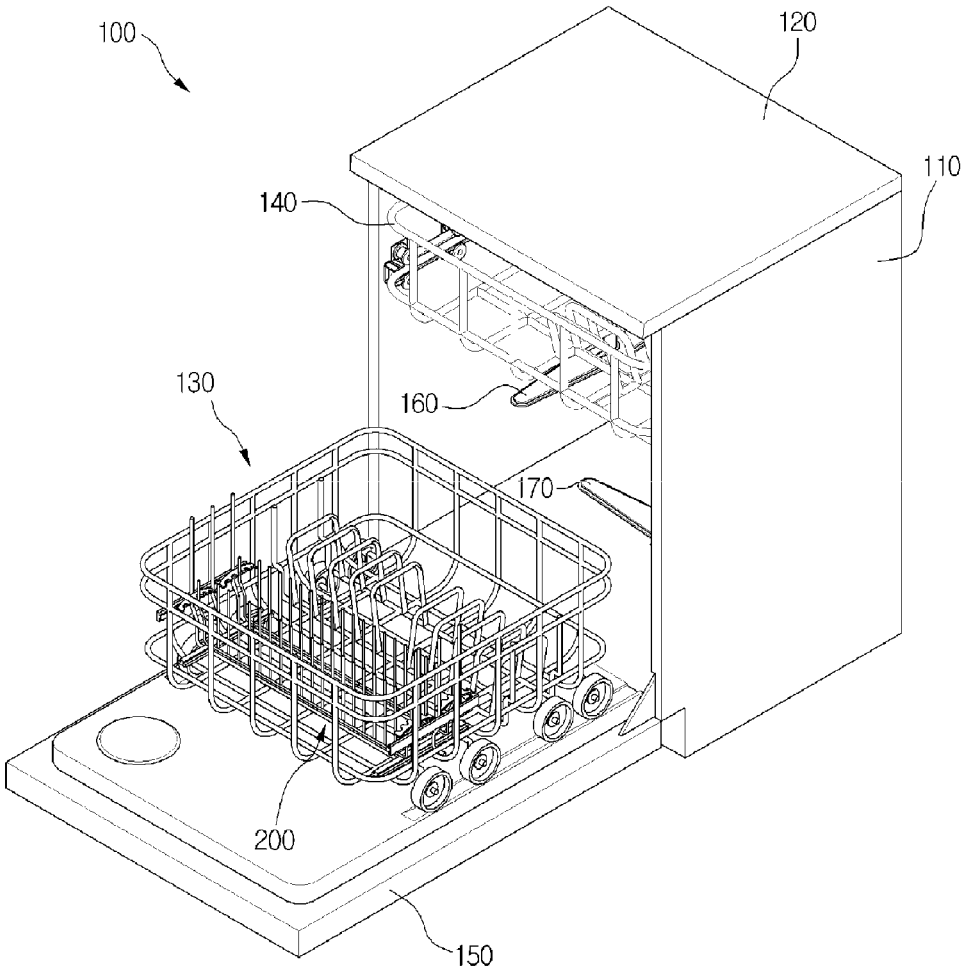
FIG. 1 is a perspective view of a dishwasher employing a rack according to the first embodiment of the present invention.

FIG. 1 is a perspective view of a dishwasher employing a rack according to the first embodiment of the present invention.

Referring to FIG. 1, a dishwasher 100 includes a tub 110 forming the outer shape thereof, a top cover 120 attached to the top surface of the tub 110, and a door 150 attached to the front of the tub 110.

The dishwasher 100 also includes an upper rack 140 and a lower rack 130 disposed inside the tub 110 for storing dishes, and a movable rack 200 installed in the upper rack 140 and/or the lower rack 130. Also included are an upper spray arm 160 for spraying wash liquid at the upper rack 140 and a lower spray arm 170 for spraying was liquid at the lower rack 130.

A brief description on the operation of the above dishwasher 100 will now be given.

First, a user opens the door 150 and places dishes in the upper rack 140 and/or the lower rack 130. Here, dishes may also be placed in the movable rack 200. After the dishes have been loaded, the upper rack 140 and/or the lower rack 130 are pushed inside the tub 110, and the door 150 is closed. After wash settings are inputted, the start button is pressed to begin dish washing according to the inputted settings.

Figure 2:
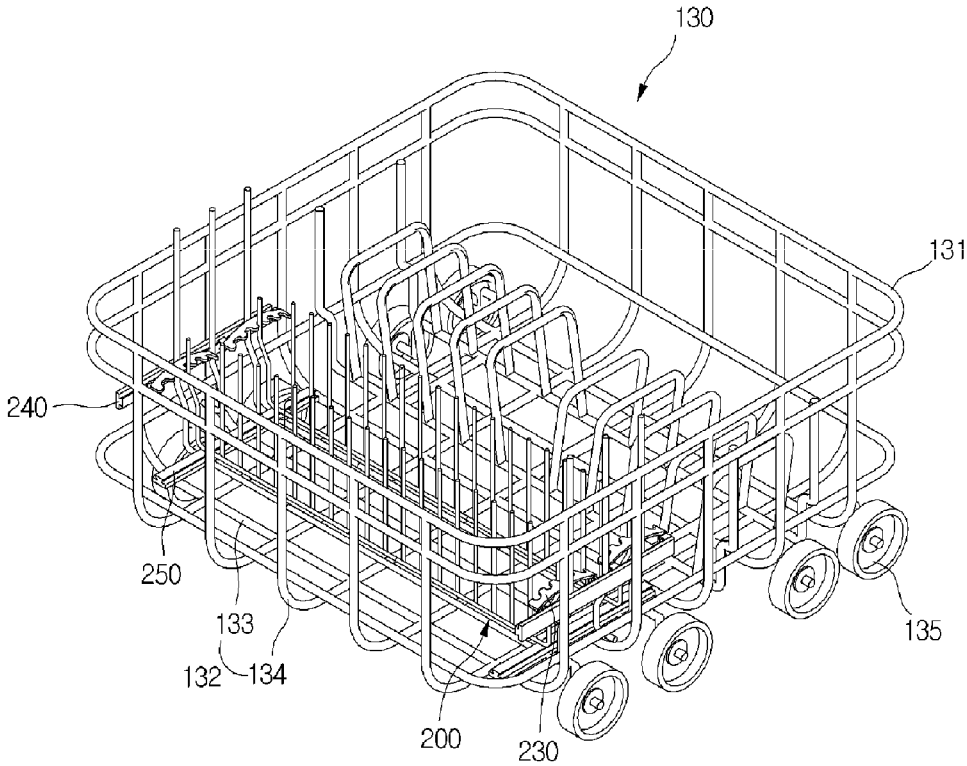
FIG. 2 is a perspective view of a rack according to the first embodiment of the present invention.
Figure 3:
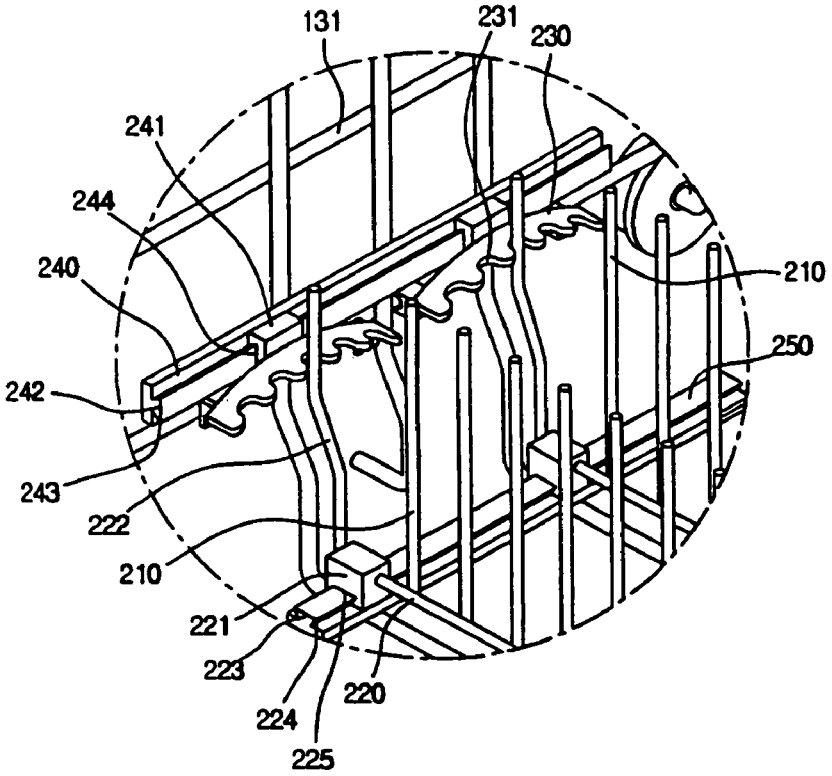
FIG. 3 is an enlarged perspective view of a portion of a rack according to the first embodiment of the present invention.

FIG. 2 is a perspective view of a rack according to the first embodiment of the present invention, and FIG. 3 is an enlarged perspective view of a portion of a rack according to the first embodiment of the present invention.

Referring to FIGS. 2 and 3, the movable rack 200 can be installed in both the upper rack 140 and the lower rack 130. For a first embodiment, the lower rack 130 will be used as an example the installation.

In detail, the lower rack 130, in which the movable rack 200 according to the present invention is provided, includes a closed loop-shaped horizontal frame 131 forming the upper and lower framework thereof, a vertical frame 132 connected to each end of the horizontal frame 131 and concaved a predetermined depth, and a rack roller 135 coupled at both lower ends of the rack for enabling forward and backward movement of the lower rack 130.

Furthermore, the vertical frame 132 includes a front-rear rack frame 134 with an end of one side thereof attached to the front of the horizontal frame 131 and the end of the other side thereof attached to the rear of the horizontal frame 131, and a left-right rack frame 133 with an end of the left side thereof attached to the left side of the horizontal frame 131 and the end of the right side thereof attached to the right side of the horizontal frame 131. Also, a movable rack 200 with a holding tine 222 having ends thereof formed to curve upward by a predetermined length is further included.

The movable rack 200 has a tine supporter 220 formed in a straight line from one end of the movable rack 200 to the other, and at least one or more movable tines 210 extending vertically upward a predetermined distance from the top of the tine supporter 220. Furthermore, the tine supporter 220 has each end curved to extend a predetermined distance upward, forming a holding tine 222. Installed at the lower curved portion of the vertical frame 132 is a movable rack rail 250 installed on the movable rack 200 to allow its forward and backward or left and right movement. The movable rack 200 is coupled to the movable rack rail 250 at the curved portion of the movable rack 200, and has a movable rack fixing portion 221 installed to allow movement thereof. The movable rack rail 250 and the movable rack fixing portion 221 allow the position of the movable rack 200 to be adjusted relative to the rack frame, and can be designated as a movable rack moving portion. The movable rack fixing portion 221 can be moved in the direction other than the movement direction of the movable rack 200.

The movable rack fixing portion 221 has a concave portion 225 formed thereon, and the movable rack rail 250 has a convex portion 223 formed along the length thereof. The convex portion 223 can be fitted in the concave portion 225. The convex portion 223 has a catch portion 224 formed at an end thereof. The catch portion 224 is formed to be a wider portion at the top of the convex portion 223 than at the bottom portion thereof, so that the catch portion 224 can prevent the convex portion 223 from dislodging from the concave portion 225. Accordingly, the movable rack 200 does not dislodge from the movable rack rail 250 due to the movable rack fixing portion 221, and is able move along the movable rack rail 250. In other words, the movable rack 200 moves along the movable rack rail 250 to adjust the gap within the movable rack 200.

Also, a tine holder 230, for securing the holding tine 222 in order to adjust the angle of the movable tines 210, is installed at a side of the vertical frame 132. Specifically, the tine holder 230 is installed at the side of the vertical frame 132, and has a tine holder rail 240 installed for allowing forward and backward movement thereof. Accordingly, the gap between the tine holders can be adjusted according to the gap within the movable rack 250. The tine holder 230 has a tine holder fixing portion 241 installed at its rear. The tine holder fixing portion 241 has a concave portion 244, and the tine holder rail 240 has a convex portion 242 formed along the length thereof. The convex portion 242 further has a catch portion 243. Thus, through the coupling of the convex portion 242 and the concave portion 244, the tine holder fixing portion 241 does not dislodge from the tine holder rail 240, but is able to move along the tine holder rail 240. The tine holder fixing portion 241 and the tine holder rail 240 is a portion that can change the position of the tine holder 230 relative to the rack frame, and can be designated as a tine holder moving portion. The tine holder moving portion can be moved in a direction other than the moving direction of the tine holder 230.

Additionally, as shown, the tine holder 230 has at least one recessed portion 231 formed therein for preventing movement of the holding tine 222 after it is pivoted and fixed at a predetermined angle. Also, the tine holder 230 is concaved at a predetermined curve radius to accurately receive the holding tine 222.

The operation of the lower rack 130 in which the movable rack 200 according to the above-described embodiment will now be addressed.

FIGS. 4 through 7 are diagrams showing the operation of the rack according to the first embodiment.

Figure 4:
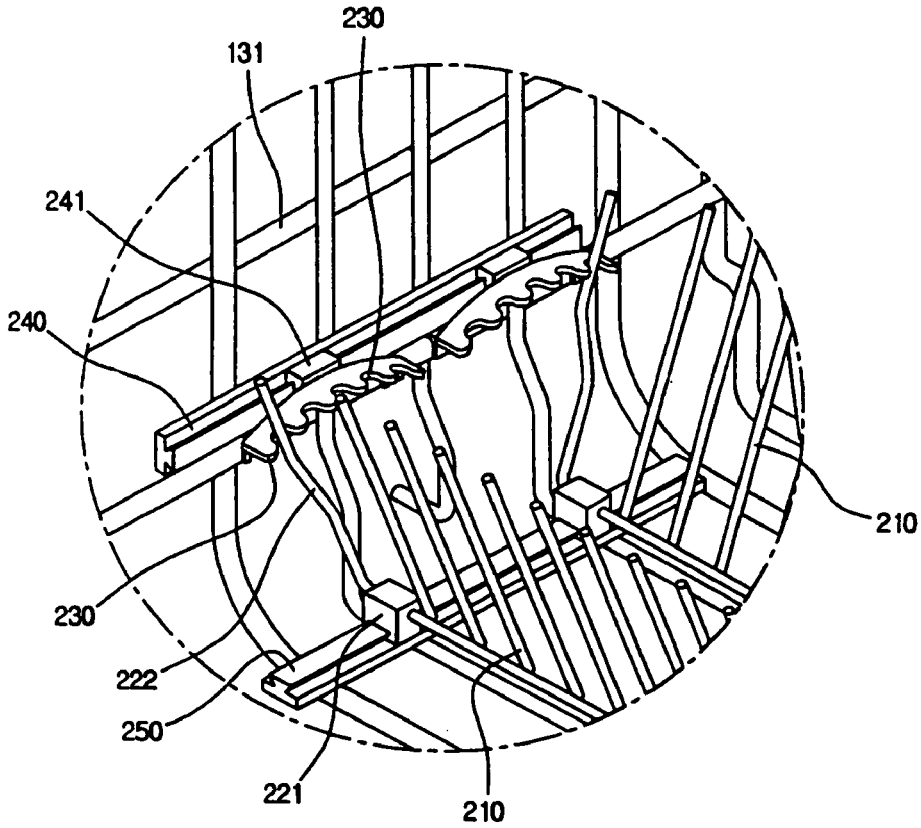
FIG. 4 is an enlarged perspective view of a portion of a rack according to the first embodiment of the present invention showing holding tines received in outer holding recesses of the tine holders.
Figure 5:
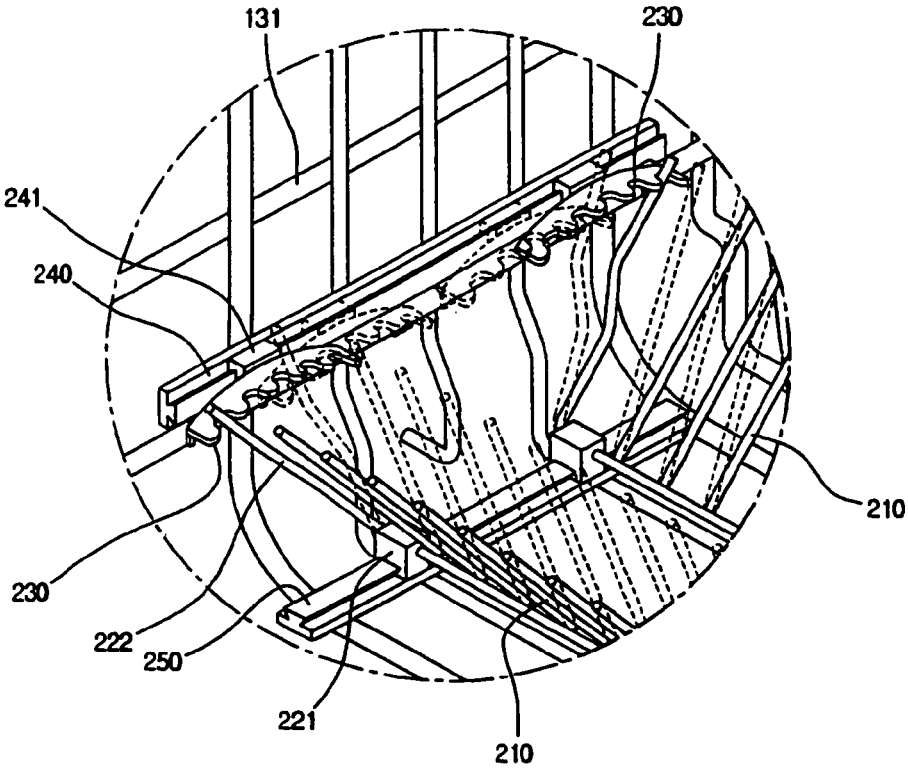
FIG. 5 is a perspective view of the tine holder in FIG. 4 showing the tine holder moving along the holder rails.
Figure 6:
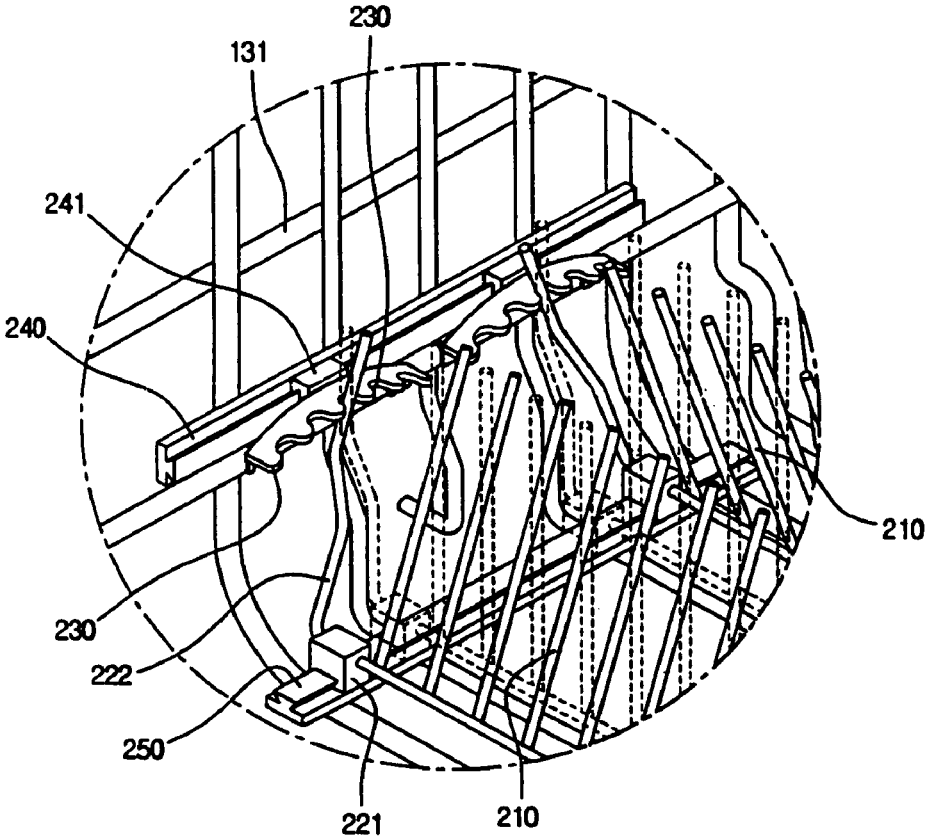
FIG. 6 is a perspective view showing the movable rack moving along the movable rack rail, according to the first embodiment of the present invention.
Figure 7:
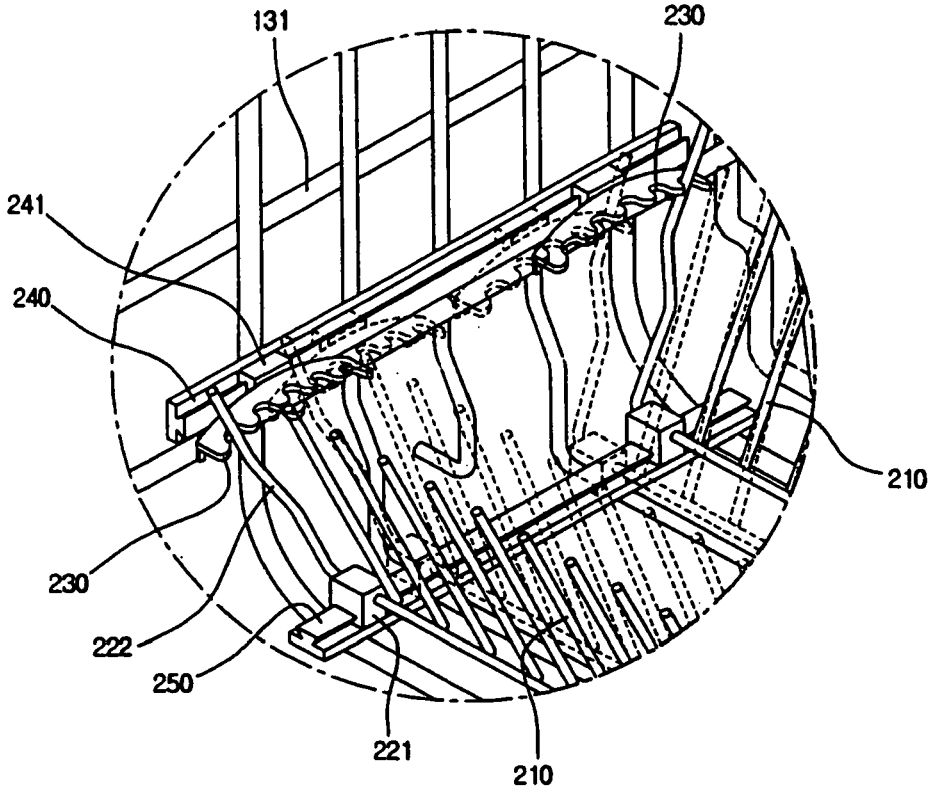
FIG. 7 is a perspective view showing the tine holder and the movable rack respectively moving along the tine holder rail and the movable rack rail, according to the first embodiment of the present invention.

FIG. 4 is an enlarged perspective view of a portion of a rack according to the first embodiment of the present invention showing holding tines received in outer holding recesses of the tine holders; FIG. 5 is a perspective view of the tine holder in FIG. 4 showing the tine holder moving along the holder rails; FIG. 6 is a perspective view showing the movable rack moving along the movable rack rail, according to the first embodiment of the present invention; and FIG. 7 is a perspective view showing the tine holder and the movable rack respectively moving along the tine holder rail and the movable rack rail, according to the first embodiment of the present invention. The operation of the lower rack 130 in which the movable rack 200 is installed, according to the first embodiment will now be described, with reference to FIGS. 4 through 7.

First, as shown in FIG. 4, the holding tine 222 pivots centrally around the movable rack fixing portion 221, and can be held in the outermost recessed portion 231 of the tine holder 230. Here, the gap between the upper portions of the opposing movable tines 210 increases, so that loading dishes can be easier. In this embodiment, dishes having sizes or shapes that prevent them from being securely stored by means of the above movement of the movable tines 210 alone, can be secured through increasing the range of movement of the movable rack 200, which is described in the following.

Referring to FIG. 5, the tine holder fixing portion 241 can move along the tine holder rail 240 by means of an external force. Here, the tine holder 230 fixed to the tine holder fixing portion 241 can move therewith. The operation, to increase the range of movement of the movable rack 200, allows the plurality of tine holders 230 to be moved in mutually-facing directions.

When the above operation is performed, the upper portions of the plurality of holding tines 222 in the outermost recessed portions 231 of the tine holders 230 are mutually spaced apart at a distance greater than that shown in FIG. 4. Thus, the upper portions of the opposing movable tines 210 formed on the movable rack are also spaced a greater distance apart than that shown in FIG. 4. Specifically, the positions of the lower portions of the holding tines 222 are fixed by the movable rack 200, but the positions of the upper portions of the holding tines 222 move along with the tine holder 230, so that the angles of the holding tines 222 change according to the change in position of the tine holder 230. Thus, the gap between the opposing movable tines 210 is greater than that shown in FIG. 4, and dishes or utensils with complex shapes can be loaded therein.

Referring to FIG. 6, the movable rack fixing portion 221 can move along the rack rail 250 by means of an external force. Here, the tine supporter 220 fixed to the movable rack fixing portion 221 can move therewith. The operation, to increase the range of movement of the movable rack 200, allows the plurality of movable rack fixing portions 221 to be moved in mutually-facing directions.

When the above operation is performed, the plurality of tine support 220 fixed to the movable rack fixing portion 221 can be moved together or apart. Here, the lower portion of the movable tines 210 formed on the tine support 220 can be moved together or apart. Thus, by increasing the space within the lower portion of the movable rack 200, odd-shaped dishes or utensils can be stored more securely.

Referring to FIG. 7, the tine holder fixing portion 241 and the movable rack fixing portion 221 can be respectively moved by means of an external force along the tine holder rack rail 240 and the movable rack rail 250. In this case, the tine holder 230 and the tine supporter 220, respectively fixed to the tine holder rail 240 and the movable rack rail 250, can be moved integrally. The operation, for increasing the range of movement of the movable rack 200, allows the plurality of tine holders 230 and the plurality of tine supporters 220 to be moved in mutually-facing directions.

When the above operation is performed, the plurality of tine holders 230 and the plurality of tine supporters 220 respectively fixed to the tine holder fixing portion 241 and the movable rack fixing portion 221 can be moved together or apart. Accordingly, the spaces within the upper and lower portions of the movable rack 200 for storing dishes can be increased, allowing an assortment of sizes and shapes of articles to be washed to be stored therein.

As described in the above embodiment, the range of movement of the movable rack 200 increases, thereby increasing dish storing effectiveness.

The tine holder rail 240 and the movable rack rail 250 are designed to be a length appropriate to the dimensions of the dish rack. Also, the size of the tine holder 230 and the number of recessed portions 231 can be designed according to the pivoting angle of the movable tine 210. The tine holder 230 can be removed from the tine holder rail 240, and the movable rack 200 can also be removed from the movable rack rail 250.

Furthermore, the installed height of the tine holder rail 240 may be adjusted according to the length of the holding tine 222. The space utilization efficiency of the movable rack can increase accordingly. Likewise, the installed height of the movable rack rail 250 may be adjusted in a forwards-backwards or a left-right direction according to the position of the movable rack 200. This also increases the space utilization efficiency of the movable rack 200.

The above-described structure allows the free adjustment of the movable rack 200, and eliminates the need to use a new movable rack 200 and tine holder 230 when a change to the dimensions of the dish rack.

The rack structure of a dishwasher according to the above structure of the present invention allows the free adjustment to the angle of the vertical tines in order to store dishes, thus allowing the collective storage of dishes of various sizes, from small to large.

Another embodiment according to the present invention will now be set forth. In the description, repetitive parts already addressed in the first embodiment will be deemed replaced by the already provided description, and thus omitted.

Figure 8:
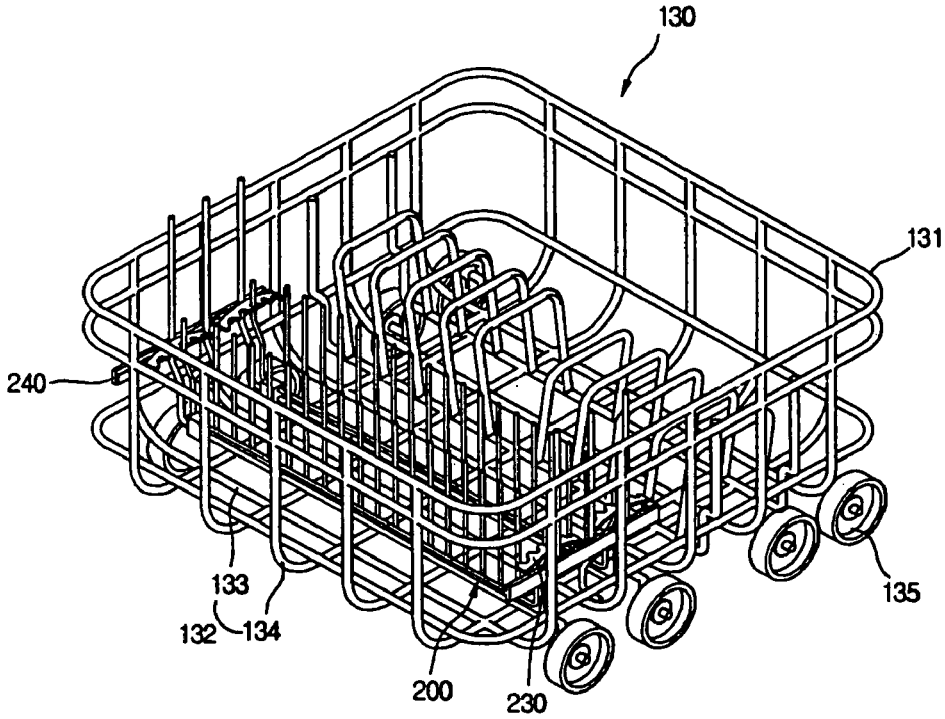
FIG. 8 is a perspective view of a rack according to a second embodiment of the present invention.
Figure 9:
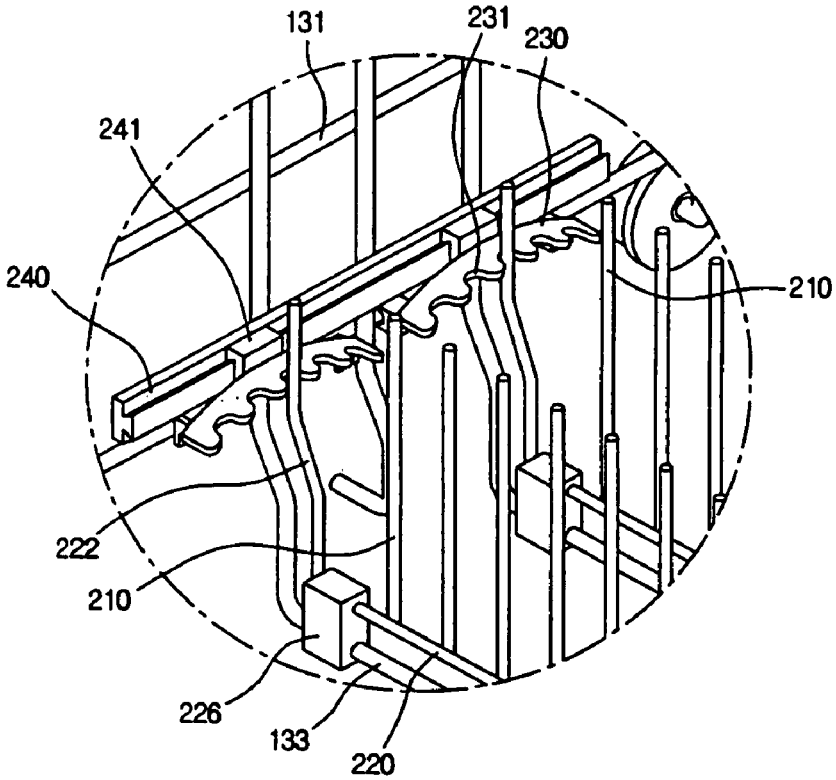
FIG. 9 is an enlarged perspective view of a portion of a rack according to the second embodiment of the present invention.

FIG. 8 is a perspective view of a rack according to a second embodiment of the present invention, FIG. 9 is an enlarged perspective view of a portion of a rack according to the second embodiment of the present invention.

Referring to FIGS. 8 and 9, a movable rack 200 is installed in the lower rack 130. Also installed is a tine holder rail 240 for guiding the movement of the movable rack 200 in the forward and backward movement directions of the lower rack 130 inside the dishwasher. A tine holder fixing portion 241 moves along the tine holder rail 240, and a tine holder 230 is fixed to the tine holder fixing portion 241.

A tine supporter 220 is installed on the movable rack 200, for supporting a holding tine 222 and a movable tine 210. The tine supporter 220 is inserted into a movable rack fixing portion 226, and is pivotably supported.

The movable rack fixing portion 226 is fixed to a portion of the frame of the lower rack 130, for example, to a left-right rack frame 133. Here, the movable rack fixing portion 226 is fixed to the left-right rack frame 133, and supports the tine supporter 220.

The operation of the movable rack 200 of the dish rack according to the above structure of this embodiment will now be described.

First, when the tine holder fixing portion 241 moves along the tine holder rail 240, the tine holders 230 attached thereto also moves. Then, the opening angle of the holding tines inserted in a selected recessed portion 231 increases. Accordingly, as the opening angle of the movable tines 210 increases, an assortment of sizes and shapes of dishes can be stored in the movable rack 200.

Here, the movable rack fixing portion 226 retains a fixed state to the left-right rack frame 133, and the tine supporter 220 pivots a predetermined angle according to the operation of the movable rack fixing portion 226 and the holding tines 222.

In this embodiment, because the tine holder 230 can move along the tine holder rail 250, the opening space within the upper portion of the movable rack 200 can be variable. This structure may be more suitable for storing dishes that require an opening at the top portion of the movable rack 200 over a variable bottom portion thereof. For optimizing purposes thereof, the manufacturing of the movable rack 200 may be facilitated.

Figure 10:
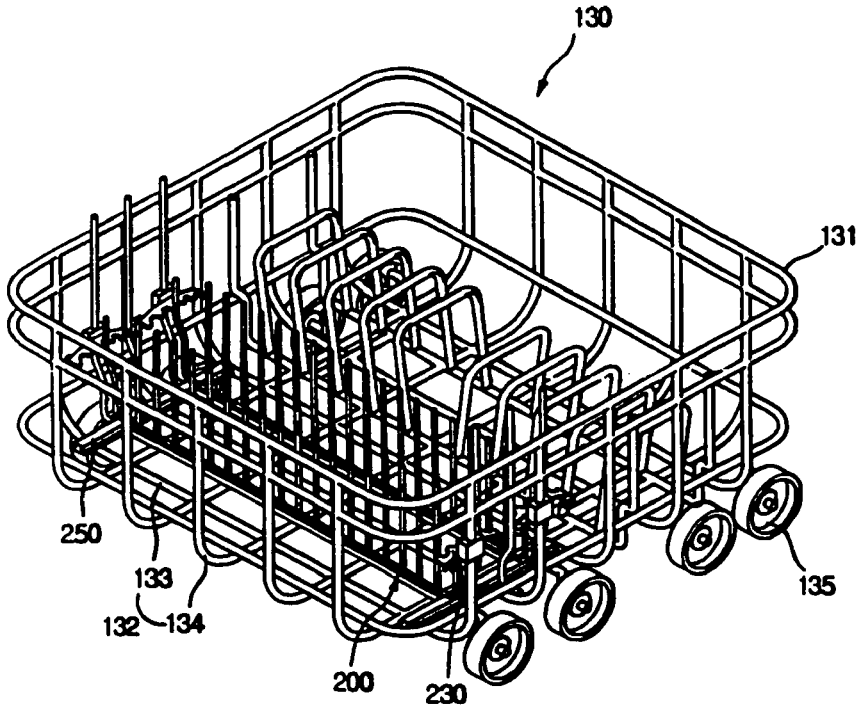
FIG. 10 is a perspective view of a rack according to a third embodiment of the present invention.
Figure 11:
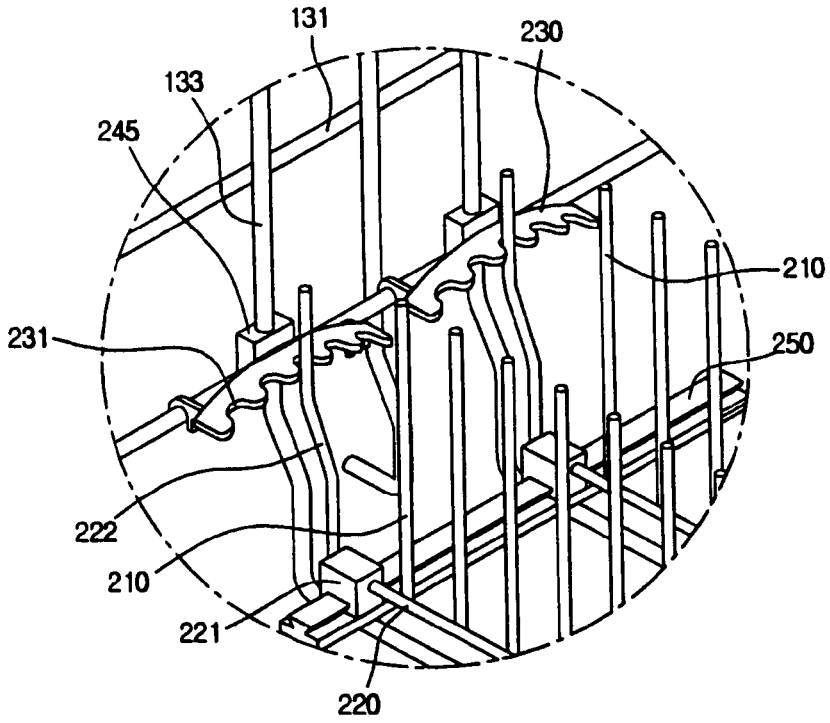
FIG. 11 is an enlarged perspective view of a portion of a rack according to the third embodiment of the present invention.

FIG. 10 is a perspective view of a rack according to a third embodiment of the present invention, and FIG. 11 is an enlarged perspective view of a portion of a rack according to the third embodiment of the present invention.

Referring to FIGS. 10 and 11, a movable rack 200 is installed in a lower rack 130. Also installed is a movable rack rail 250 for guiding the movement of the movable rack 200 in the forward and backward movement directions of the lower rack 130 inside the dishwasher. A movable rack fixing portion 221 moves along the movable rack rail 250, and a tine supporter 220 is coupled to the movable rack fixing portion 221. The tine supporter 220 can pivot in the movable rack fixing portion 221.

A tine holder fixing portion 245 is coupled to a left-right rack frame 133. A tine holder 230 is fixed to the tine holder fixing portion 245. Here, the tine holder 230 may be fixed to the left-right rack frame 133 by means of the tine holder fixing portion 245.

The operation of the movable rack 200 in the dish rack according to the above structural embodiment will now be described.

First, when the movable rack fixing portion 221 moves along the movable rack rail 250, the tine supporter 220 inserted therein also moves. Then, the space between the plurality of tine supporters 220 and the opening angle in the lower portion of the movable rack 200 increase. Accordingly, a wide assortment of sizes and shapes of dishes can be stored in the movable rack 200.

Here, the tine holder fixing portion 245 maintains a fixed state to the left-right rack frame 133, and the tine holder 230 has its position fixed by the tine holder fixing portion 245.

In the above embodiment according to the present invention, the tine supporter 220 can move along the movable rack rail 250, so that the range of the opening of the movable rack 200 can be variable. This structure may be more suitable for storing dishes that require an opening at the bottom portion of the movable rack 200 over a variable top portion thereof. For optimizing purposes thereof, the manufacturing of the movable rack 200 may be facilitated.

The dishwasher rack according to the present invention allows free adjustment to the angle and variable range of the vertical tines in order to store dishes, thus allowing the collective storage of dishes of various sizes (from small to large) and shapes.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher rack comprising:
a rack frame;
a movable rack provided in the rack frame and including a holding tine;
a tine holder including a plurality of portions formed to receive the holding tine for adjusting a gap between the holding tine and a structure opposite to the holding tine, according to a received position of the holding tine;
a tine holder fixing portion for fixing the tine holder;
a tine holder rail installed on the rack frame, the tine holder fixing portion being slidably coupled to the tine holder rail;
a movable rack fixing portion for fixing the movable rack; and
a movable rack rail installed on the rack frame, the movable rack fixing portion being slidably coupled to the movable rack rail,
wherein the movable rack is rotatably coupled to the movable rack fixing portion.

2. The dishwasher rack according to claim 1, wherein the holding tine includes a lower portion fixed with respect to the movable rack, an upper portion that moves together with the tine holder, and an angle of disposition that varies according to the position of the tine holder.

3. The dishwasher rack according to claim 1, wherein the tine holder fixing portion has a concave portion for coupling to a convex portion of the tine holder rail.

4. The dishwasher rack according to claim 1, wherein the movable rack fixing portion has a concave portion for coupling to a convex portion of the movable rack rail.

5. A dishwasher rack comprising:
a rack frame;
a movable rack rotatably coupled to the rack frame, including a holding tine;
a tine holder including a plurality of portions formed to receive the holding tine for adjusting a gap between the holding tine and a structure opposite to the holding tine, according to a received position of the holding tine;
a tine holder fixing portion for fixing the tine holder; and
a tine holder rail installed on the rack frame, the tine holder fixing portion being slidably coupled to the tine holder rail.

6. The dishwasher rack according to claim 5, wherein the tine holder fixing portion has a concave portion for coupling to a convex portion of the tine holder rail.

7. The dishwasher rack according to claim 6, wherein the tine holder rail has a catch portion formed thereon for preventing the tine holder fixing portion from detaching from the tine holder rail.

8. The dishwasher rack according to claim 5, wherein the holding tine includes a lower portion fixed with respect to the movable rack, an upper portion that moves together with the tine holder, and an angle of disposition that varies according to the position of the tine holder.

9. The dishwasher rack according to claim 5, wherein portions formed to receive the holding tine included by the tine holder are recessed portions.

10. A dishwasher rack comprising:
a rack frame;
a movable rack provided in the rack frame;
a movable rack fixing portion to which the movable rack is rotatably coupled;
a movable rack rail installed on the rack frame and formed for allowing a movement of the movable rack fixing portion, the movable rack fixing portion being slidably coupled to the movable rack rail;
a tine holder configured to receive a portion of the movable rack; and wherein the movable rack includes a tine supporter rotatably coupled to the movable rack fixing portion and a holding tine extended from an end of the tine supporter, the tine supporter rotates together with the holding tine.

11. The dishwasher rack according to claim 10, wherein the movable rack fixing portion has a concave portion for coupling to a convex portion of the movable rack rail.

12. The dishwasher rack according to claim 11, wherein the movable rack rail has a catch portion formed thereon for preventing the movable rack fixing portion from detaching from the movable rack rail.

* * * * *